US005692833A

United States Patent [19]

DeLuca

[11] Patent Number: 5,692,833

[45] Date of Patent: Dec. 2, 1997

[54] INFLATABLE PACKAGING CONE AND METHOD OF MAKING THE SAME

[75] Inventor: Nicholas Paolo DeLuca, Jamaica Plain, Mass.

[73] Assignee: Novus Packaging, San Francisco, Calif.

[21] Appl. No.: 329,207

[22] Filed: Oct. 26, 1994

[51] Int. Cl.[6] ..... B65D 30/02

[52] U.S. Cl. ..... 383/3; 206/522; 206/446; 383/907

[58] Field of Search ..... 363/3, 907; 206/522, 206/822, 446

[56] References Cited

U.S. PATENT DOCUMENTS

| | | | |
|---|---|---|---|
| 2,127,631 | 8/1938 | Nagle | 383/907 |
| 2,651,314 | 9/1953 | Hasselquist | 206/522 |
| 3,891,082 | 6/1975 | Fall | 206/522 |
| 4,044,867 | 8/1977 | Fisher | 383/3 |
| 4,164,970 | 8/1979 | Jordan | 383/3 |
| 4,384,602 | 5/1983 | Ores | 383/3 |
| 4,574,953 | 3/1986 | Garbuzov | 206/522 |
| 4,705,085 | 11/1987 | Brown | 206/522 |
| 4,809,352 | 2/1989 | Walker | 383/3 |
| 4,941,754 | 7/1990 | Murdock | 383/3 |
| 4,946,290 | 8/1990 | Matyja | 383/907 |
| 5,454,642 | 10/1995 | De Luca | 383/3 |

FOREIGN PATENT DOCUMENTS

| | | | |
|---|---|---|---|
| 7500147 | 7/1976 | Netherlands | 383/907 |
| 848248 | 9/1960 | United Kingdom | 206/522 |

*Primary Examiner*—Stephen P. Garbe
*Attorney, Agent, or Firm*—Rines and Rines

[57] ABSTRACT

A two-dimensional inflatable heat-sealable thin-film form is provided for creating a three-dimensional inflated cone with a recess in the base of the cone, useful as a carrying pouch or as an end-cap for cushioning, as well as thermal protection. A preferred manufacturing in-line process for making the cone is also described.

8 Claims, 6 Drawing Sheets

INFLATABLE PACKAGING CONE AND METHOD OF MAKING THE SAME

The present invention relates to an inflatable cone assembly for use in decorative packaging applications, as well as for thermal and shock protective packaging applications.

BACKGROUND OF THE INVENTION

The design and manufacture of flexible inflatable objects has a broad range of applications throughout the present day transportation, medical, packaging, and toy industries. In many of these applications, an inflatable envelope assumes a flat, two dimensional structure prior to inflation and, upon filling, transforms into a three dimensional object. The ability to create a three dimensional object with an inflatable envelope is primarily affected by the manufacturing process used, and secondarily affected by factors such as flexibility and strength of the material used. In most of these applications, the manufacture of an inflatable envelope is accomplished in one of the following two basic methods: 1) overlaying two separate sheets of impermeable material and heat sealing the desired inflatable form on the material or 2) by casting or blowing a curable flexible material into a mold. While forming the inflatable with a three-dimensional mold provides the most effective method for creating a three-dimensional shape, this process carries high capital equipment and mold costs, and requires the use of a curable material. The low cost associated with two-dimensional stamping on flat sheets makes such method appealing for use in some applications; though the facility in creating a three-dimensional object is greatly impaired.

As an example, in the toy industry, the production of metalized balloons is done using a heat-sealing platen on two imposed plastic sheets, while latex balloons are made by dipping latex over a mold. In observation of the balloons created with each process, one observes that metalized balloons are less prominent as three-dimensional objects compared to latex balloons. The more spherical shape of a latex or rubber balloon is attainable primarily because it is manufactured by molding in the form of a sphere. On the other hand, molding must be done with a curable semi-flexible material; thus ruling-out the use of the more impermeable metalized material used with the metalized film balloon, such material permitting extended inflation times compared to unmetalized latex. Thus, the assessment of methodology for the creation of an inflatable three-dimensional object must be considered very carefully when creating such an object.

With specific regard to the creation of inflatable conical structures, to date, such structures have heretofore been formed with a molding process, which, as explained before, is inherently expensive and limited in material selection. In addition, such structures lack capability to serve as pockets for items disposed within the interior base of the cone.

OBJECT OF INVENTION

A primary object of the present invention, therefore, is to provide a new inflatable structure closely resembling a cone, and to provide a novel method for its manufacture using a formed two-dimensional platen; such cone having a conical recess extending from the base of the cone that permits the placement of an object within such recess for shock and/or thermal protection.

It is also an object of this invention to provide a novel inflatable cone with a metalized material for use as a thermal protective barrier of the contents of the inner recess.

A further object is to provide an inflatable object of the character described which resembles an ice-cream cone for decorative and novelty purpose.

Other and further objects will be explained hereafter and more particularly pointed out in connection with the appended claims.

SUMMARY

From one of its viewpoints, the invention, in summary, provides an inflatable cone formed from a fan-like sealed envelope segmented into successive segment sectors defined by radial sealing lines converging from a circular perimeter edge of the fan radially toward but not reaching the center, leaving a lower pocket; the envelope being bendable into a conical shape with the lower pocket wrapped around the cone vertex to hold the shape and provide an inner storage recess; and valve means at the upper edge for inflating the envelope sectors to provide the resulting cone with successive scalloped inflated segments.

Preferred and best mode designs and forming techniques are hereafter described.

DRAWINGS

The invention will now be described in connection with the accompanying drawings in which.

DESCRIPTION OF INVENTION

Figure 1:
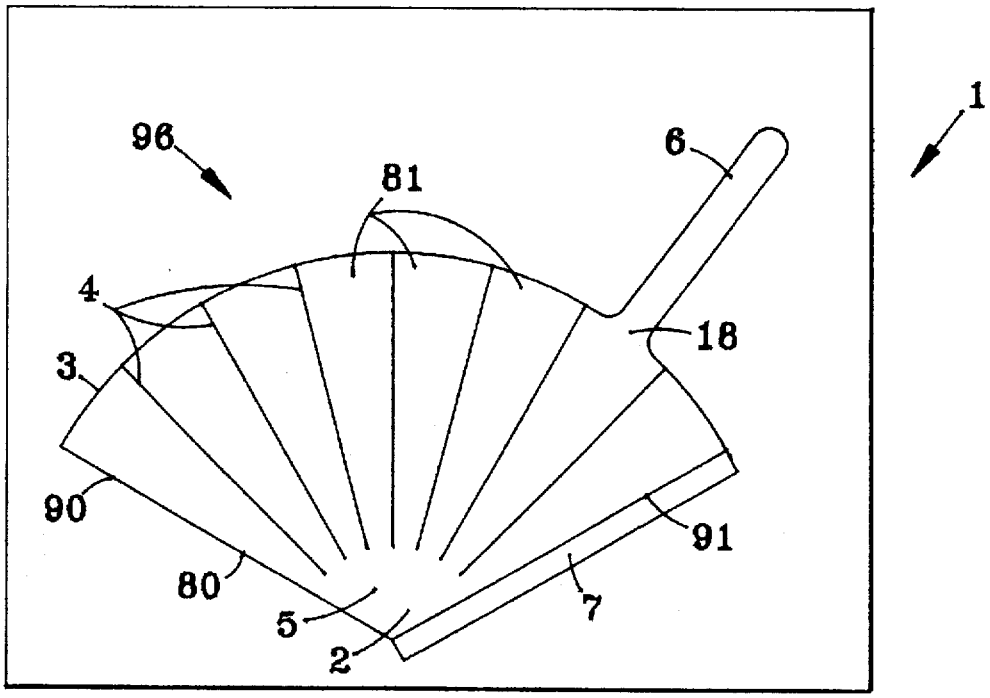
FIGS. 1 and 2 are two-dimensional views of heat-sealing platens used to create the inflatable cone of the invention.
Figure 2:
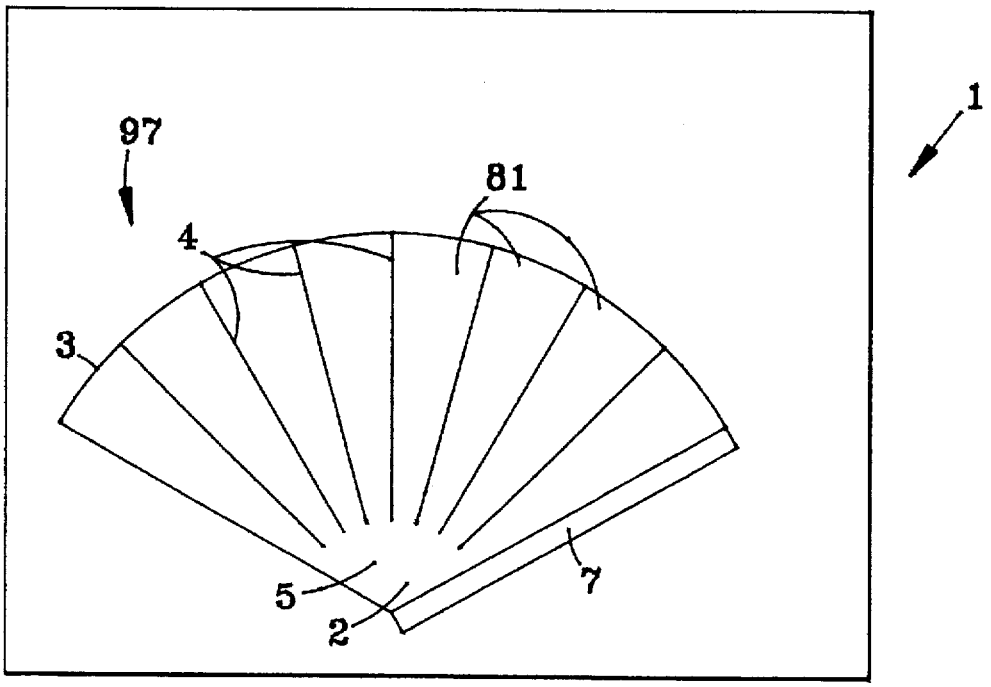
Figure 3:
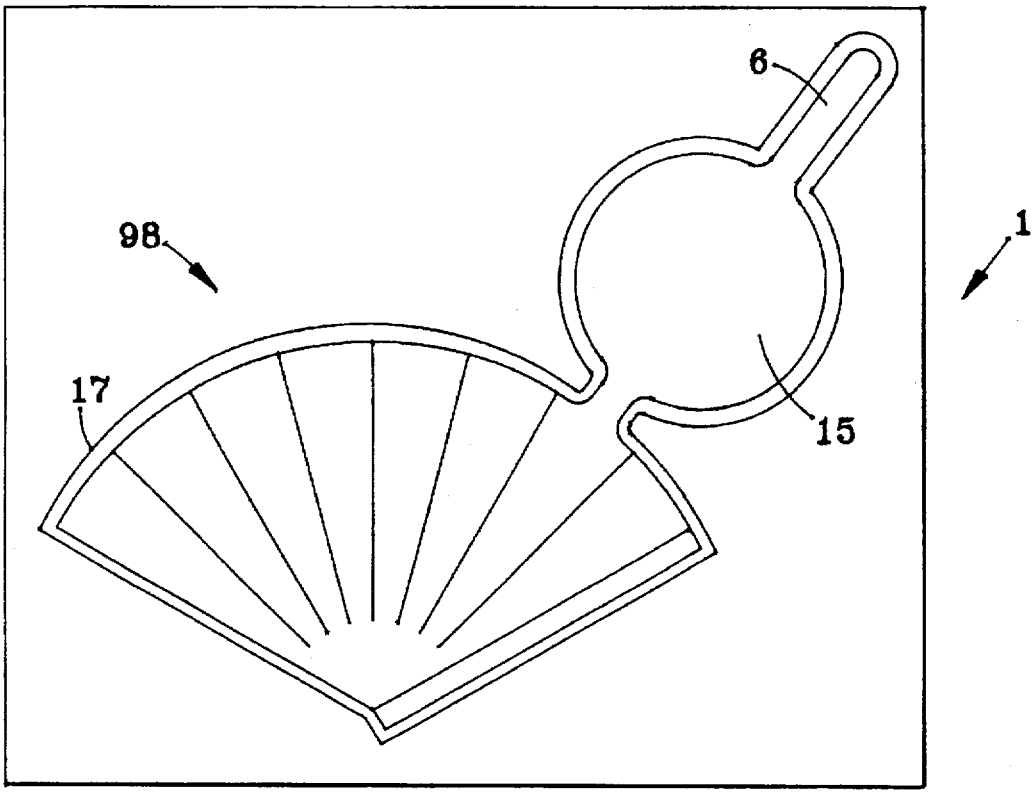
FIG. 3 is a two-dimensional view of a platen used to create an inflatable cone with an adjoining balloon cap.

FIGS. 1, 2, and 3 illustrate heat-sealing platens 1 used in the formation of an inflatable cone using thin-film heat-sealable sheet materials. Such platens are most commonly machined using aluminum and formed so as to create raised edges corresponding to the desired heat-sealable pattern. The shapes 96, 97, 98 within the rectangular boundaries of platen 1 in FIGS. 1, 2, and 3 are raised edges. In manufacturing, these platens are heated and pressed against thin film flexible heat-sealable materials so as to form the desired shape.

The heat-sealing shape 96 in FIG. 1 may be characterized as a fan-like section or "pie piece" from a circular form with radius 80, section angle 2 and circumferencial perimeter generally following the circumferential arc 3. This section also has radial heat-sealing lines 4 beginning at and converging from the circumferential perimeter edge and extending radially inwards towards, but not reaching the center of the circular section, leaving common area 5, within the radial edges of section angle 2 that joins all the successive segment sector strips 81 formed between radial heat-sealing lines 4. Depending on the desired size of the cone, the conical storage recess, and conical angle, dimensional parameters 2, 80, 3, and 4 may be changed. Such form 96 also has an extension 7 along a radial edge of the section that has a closed perimeter from the rest of the "pie" section. Strip 7 is used to seal the two radial edges 90 and 91 together when wrapping the cone from thin film material. Form 96 also includes a channel 6 that is used for filling the cone with a filler medium, such as air, such channel connecting to the common area 5 to permit filling of all the successive segment sector strips 81. After filling, stem 6 may be sealed permanently in region 18.

Figure 4:
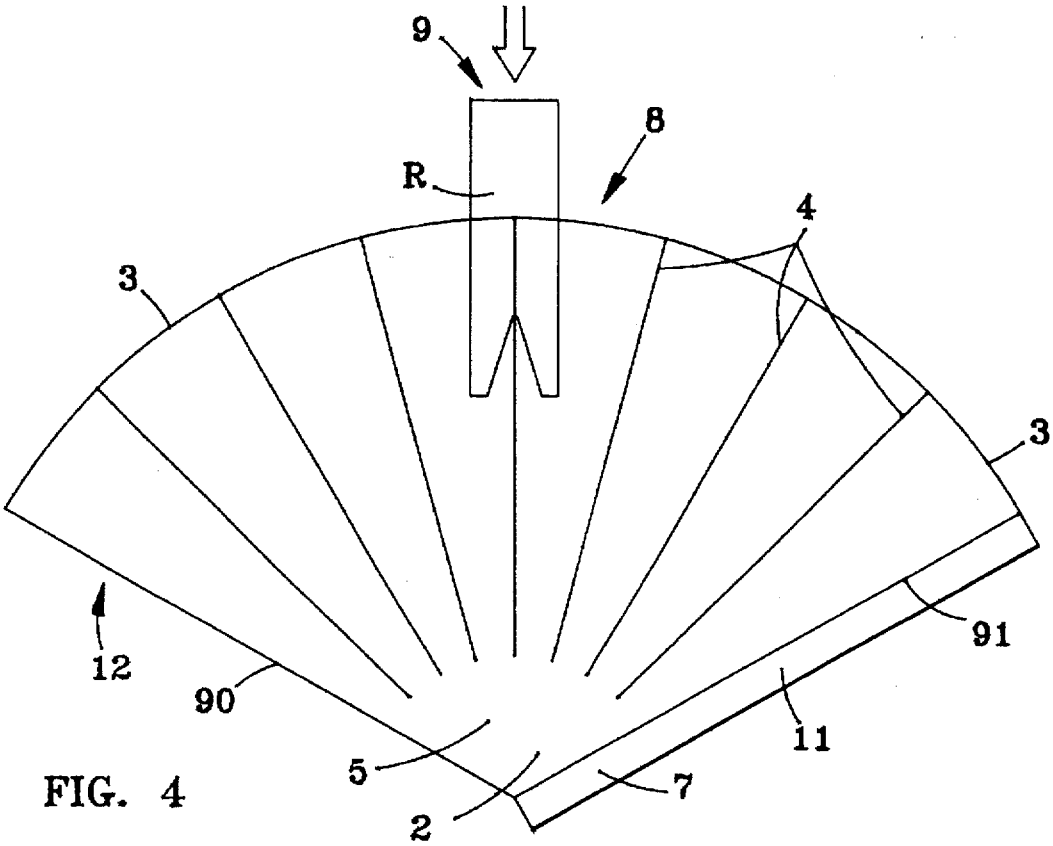
FIG. 4 is a two-dimensional view of the assembly of such a cone incorporating a one-way valve.

While the platen in FIG. 1 is used in forming a cone that is inflatable through channel 6 and further sealed in region 18, heat-sealing form 97 in FIG. 2, although similar, is intended to be used with a one-way valve. One such valve 8 is shown in FIG. 4 as a completed assembly after pressing with a platen similar to that in FIG. 2. The one-way valve 8, as described in co-pending application U.S. Ser. No. 278, 610, filed Jul. 21, 1994, now abandoned, for example, is located at the appropriate location R between material layers prior to heat-sealing. Inflation is done through opening 9 of the valve.

Figure 6:
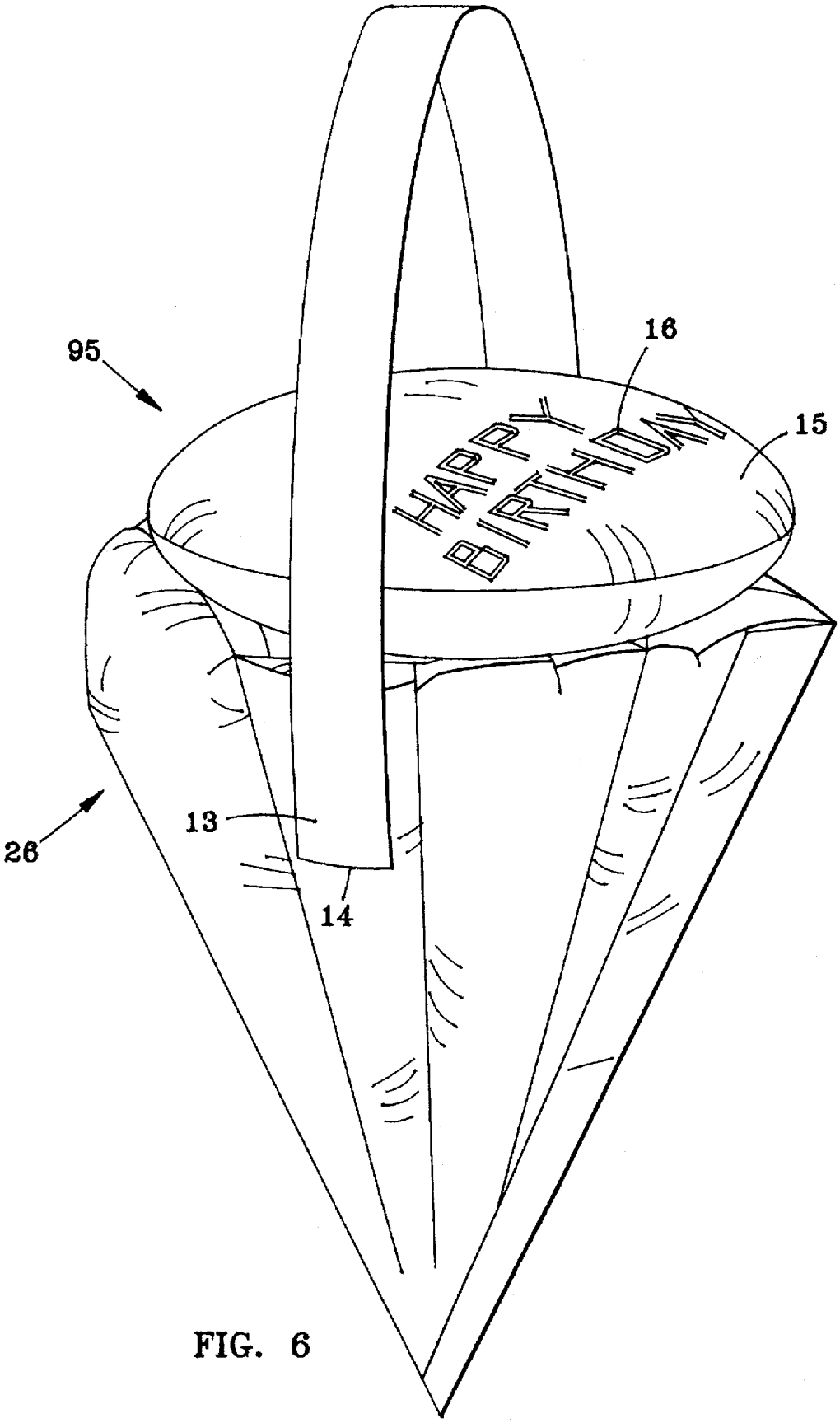
FIG. 6 is an orthogonal view of an inflatable cone with a closure or cap for the base recess and a carrying strap for use of the cone as a bag.

Form 98, described in FIG. 3, is also similar to form 96 yet incorporates a balloon cap 15 for covering the cone once assembled, as shown in FIG. 6. With form 96, the filling channel 6 is connected to balloon 15. In addition, form 98 incorporates a peripheral cutting edge 17 that separates form 96 from the roll stock of the material used.

Figure 5:
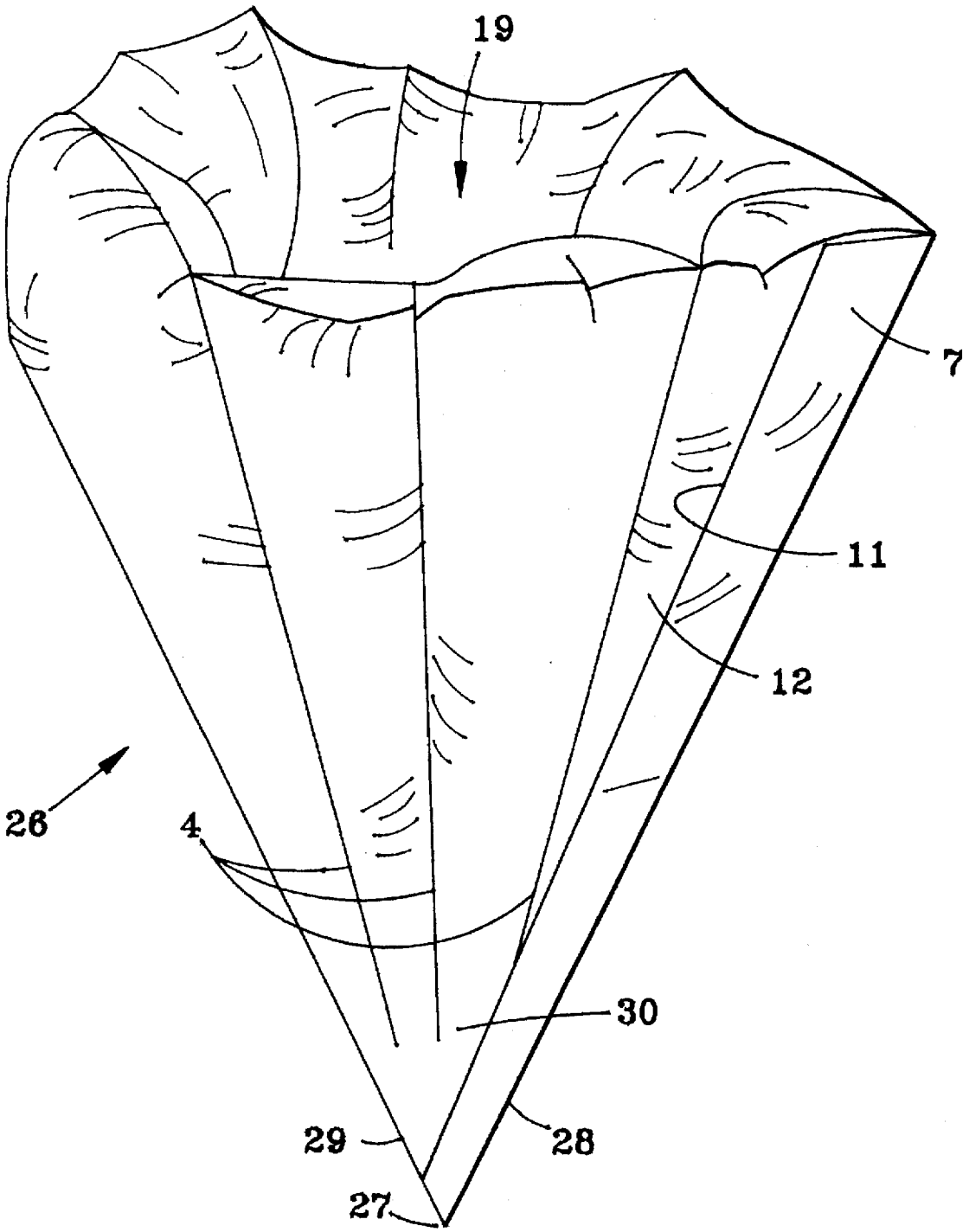
FIG. 5 is an orthogonal view of the inflated cone.

In assembling forms 96, 97, 98 created using platen 1 in FIGS. 1, 2, and 3, to create from the thin-film envelope a cone 26 as shown in FIG. 5, the radial edges 90 and 91 of the "pie" section must be wrapped-around and held together. One method involves placing adhesive on flap 7 at top surface 11, in FIG. 4, and adhering surface 11 to surface 12 which forms the underside of the radial section 81 at the edge 90. The cone is further inflated forming the scalloped cone 26 of FIG. 5, having a storage pocket 19, a vertex 27 formed by wrapping sides 28 and 29 around, and a bottom cone recess region 30.

Cone 26 in FIG. 5 may be further modified as shown in FIG. 6, to form a pouch 95 that has a removable covering cap 15 upon which a message 16 may be printed for toy, novelty, or gift uses. The covering cap 15 may be an inflatable balloon of cross-dimension similar to that of the cone opening at its upper edge. Pouch 95 may be carried via a U-shaped handle 13, which is adhered to cone 26 at areas 14 and hinges the cone opening between opposite sides of the cone. Making such cone out of material that has high thermal reflectivity, such as metalized plastic sheeting, permits such a cone to be used as a thermal container for frozen food, such as ice-cream or the like.

Figure 7:
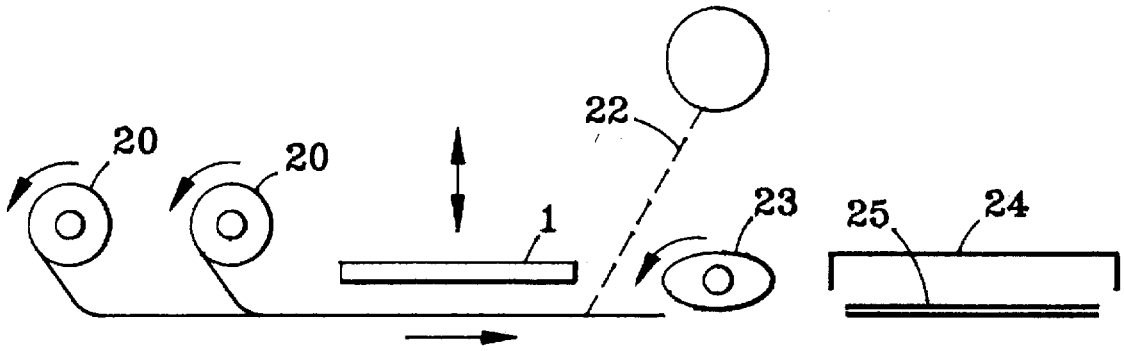
FIG. 7 is an orthogonal view of a preferred manufacturing method for manufacturing the cone.

FIG. 7 is a schematic drawing of a manufacturing line employing a preferred method of making the cone 26. Roll-stock 20 is pressed using platen 1 and either rolled back-up onto spool 22 or further assembled using an assembly spindle 23. Spindle 23 enables the formation of cone 26 by bringing together and adhering edges 90 and 91. Cone 26 may be further stacked into packages 25 by a packaging machine 24.

Figure 8:
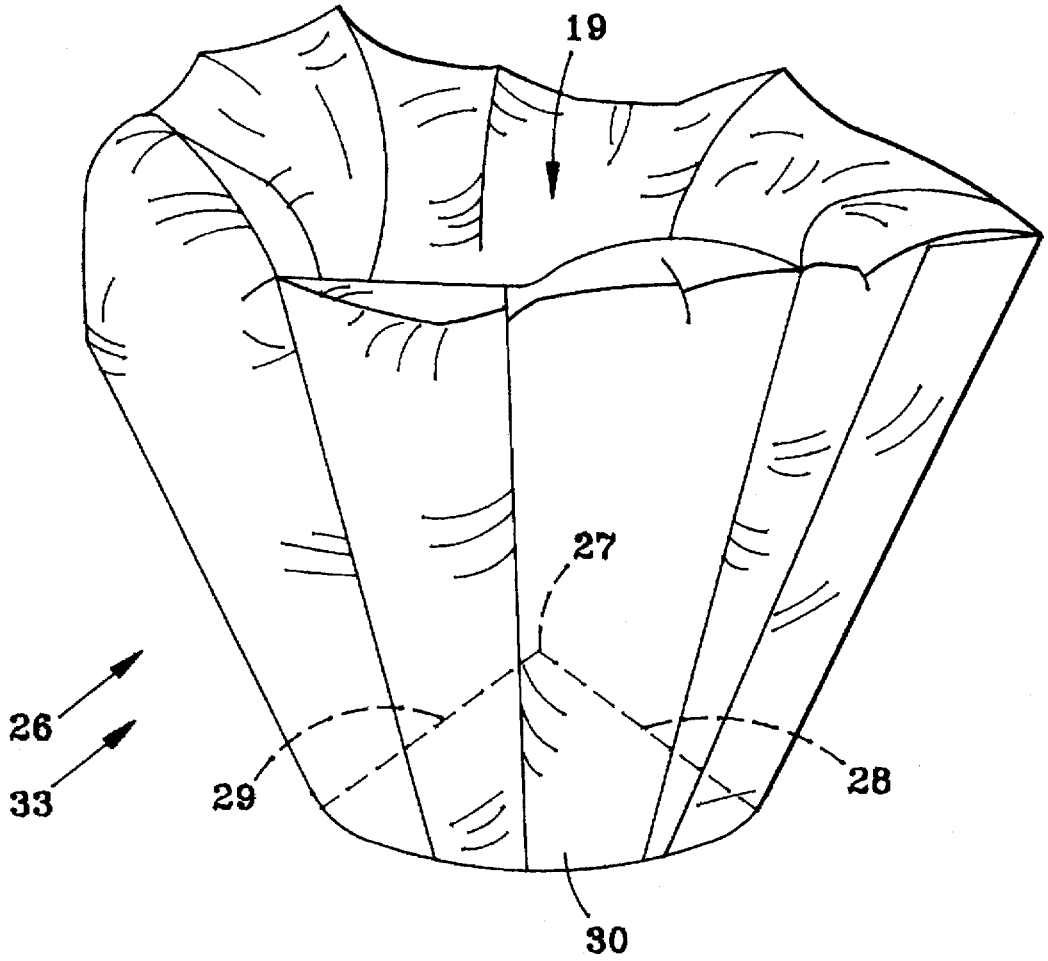
FIG. 8 is an orthogonal view of a protective cap made from the cone.
Figure 9:
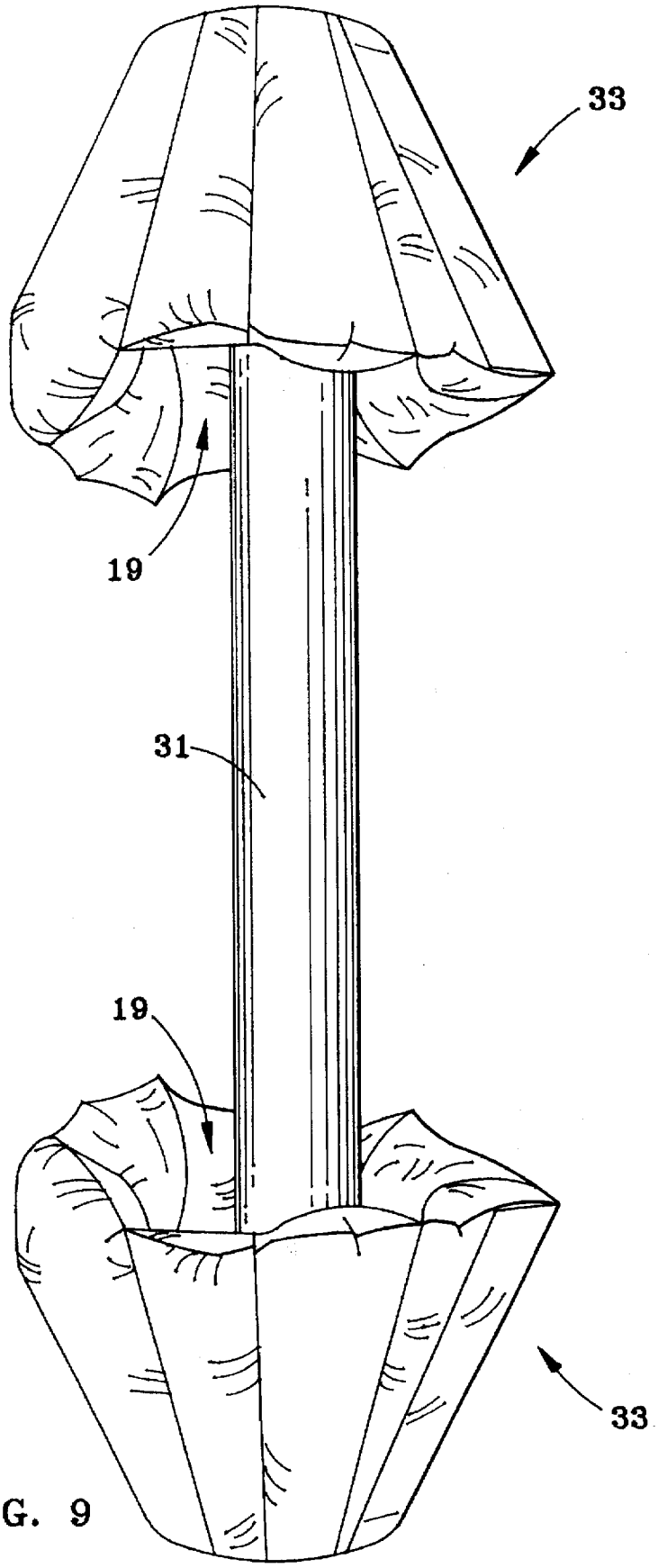
FIG. 9 is an orthogonal view of the protective caps used as end-caps for a rod.

Modification of cone 26 to serve as a protective end-cap 33 is shown in FIG. 8. Vertex 27 is pushed into the bottom of the cone, forcing edges 28 and 29 into the interior of the cone. Sealing in area 30 may be done by thermal or mechanical means to separates areas 81 in FIG. 1 from each other; thus, creating a much stronger protective cone. End-cap 33 may also be used for thermal or shock protection of a rod during shipment, as shown in FIG. 9, by placing rod 31 into end pockets 19.

Further modifications will occur to those skilled in this art, and such are considered to fall within the spirit and scope of the invention as defined in the appended claims.

What is claimed is:

1. An inflatable cone formed from a fan-like sealed envelope segmented into successive segment sectors defined by radial sealing lines converging from a circular perimeter edge of the fan radially toward but not reaching the center vertex, leaving a lower V-shaped pocket; the envelope being of conical shape with the lower pocket forming the cone vertex to hold the shape and provide an inner storage recess; and means at the upper perimeter edge of a segment sector for inflating the envelope sectors through said sector into the lower pocket and thence into the other segment sectors to provide the resulting cone with successive scalloped inflated segments.

2. An inflatable cone as claimed in claim 1 and in which the envelope walls are metalized plastic sheeting, and the interior space within the cone is adapted for receiving and storing articles.

3. An inflatable cone as claimed in claim 2 and in which an inflatable balloon is attached to a region of the upper edge of the cone to serve as a cap for the cone.

4. An inflatable cone as claimed in claim 3 and in which the balloon is of cross-dimension similar to that of the cone at its upper edge.

5. An inflatable cone formed from a fan-like sealed envelope segmented into successive segment sectors defined by radial sealing lines converging from a circular perimeter edge of the fan radially toward but not reaching the center, leaving a lower pocket; the envelope being of conical shape with the lower pocket forming the cone vertex to hold the shape and provide an inner storage recess; and means at the upper edge for inflating the envelope sectors to provide the resulting cone with successive scalloped inflated segments and in which the vertex is pushed into the bottom of the cone.

6. An inflatable cone as claimed in claim 1 and in which an adhesive strip is provided at an edge of the fan to secure the wrapped cone.

7. An inflatable cone as claimed in claim 1 and in which a U-shaped handle is connected between opposite sides of the cone bridging the opening thereof.

8. An inflatable cone as claimed in claim 5 combined with a rod and insertable over the end thereof.

* * * * *